US008979586B2

(12) United States Patent
Wu et al.

(10) Patent No.: US 8,979,586 B2
(45) Date of Patent: Mar. 17, 2015

(54) CABLE CONNECTOR HAVING A CABLE WITH A METALLIC PIECE BETWEEN CONDUCTIVE WIRES

(71) Applicant: Hon Hai Precision Industry Co., Ltd., New Taipei (TW)

(72) Inventors: Jerry Wu, Irvine, CA (US); Jun Chen, Kunshan (CN); Zhuang-Zhi Wu, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 25 days.

(21) Appl. No.: 13/940,277

(22) Filed: Jul. 12, 2013

(65) Prior Publication Data

US 2014/0017926 A1 Jan. 16, 2014

(30) Foreign Application Priority Data

Jul. 12, 2012 (CN) ..... 2012 1 040269

(51) Int. Cl.

| | |
|---|---|
| ***H01R 13/648*** | (2006.01) |
| ***H01R 13/6463*** | (2011.01) |
| ***H01R 13/6461*** | (2011.01) |
| ***H01R 13/6585*** | (2011.01) |
| ***H01R 24/64*** | (2011.01) |

(52) U.S. Cl.

CPC ..... *H01R 13/6463* (2013.01); *H01R 13/6461* (2013.01); *H01R 13/6585* (2013.01); *H01R 24/64* (2013.01)

USPC ..... 439/607.28

(58) Field of Classification Search

USPC ..... 439/676, 607.01, 607.23, 607.28

See application file for complete search history.

(56) References Cited

U.S. PATENT DOCUMENTS

| | | | | |
|---|---|---|---|---|
| 6,454,605 | B1 * | 9/2002 | Bassler et al. | 439/607.23 |
| 7,601,029 | B2 * | 10/2009 | Horiuchi et al. | 439/607.01 |
| 7,819,675 | B2 * | 10/2010 | Ko et al. | 439/98 |
| 2004/0038564 | A1 * | 2/2004 | Yan | 439/76.1 |
| 2009/0197467 | A1 * | 8/2009 | Ko et al. | 439/607.28 |
| 2014/0065884 | A1 * | 3/2014 | WU et al. | 439/626 |

FOREIGN PATENT DOCUMENTS

| | | |
|---|---|---|
| TW | M240719 | 8/2004 |

* cited by examiner

*Primary Examiner* — Chandrika Prasad

(74) *Attorney, Agent, or Firm* — Wei Te Chung; Ming Chieh Chang

(57) ABSTRACT

A cable connector assembly for mating with a complementary connector comprises: an insulative housing defining a receiving space and a plurality of receiving slots communicated with the receiving space; a wire management received into the receiving space; a twisted-pair cable having a plurality of first and second conductive wires assembled to the wire management and located on different planes; a metallic piece assembled to the wire management and disposed between the plurality of first and second conductive wires; and a plurality of terminals received into the plurality of receiving slots and pierced into the plurality of first and second conductive wires.

12 Claims, 5 Drawing Sheets

CABLE CONNECTOR HAVING A CABLE WITH A METALLIC PIECE BETWEEN CONDUCTIVE WIRES

BACKGROUND OF THE INVENTION

1. Field of the Invention

The present invention relates to a cable connector assembly, and more particularly to a cable connector assembly having a device for preventing crosstalk.

2. Description of Related Art

TW Patent No. M240,719 issued to Lin on Aug. 11, 2004 discloses a high speed performance RJ45 plug according to category 6 of communication standard. The RJ45 plug comprises an insulative housing, a spacer assembled to the insulative housing, a plurality of contacts accommodated into the insulative housing and a twisted-pair cable having four pairs of wires arranged by the spacer and electrically connected to the contacts. The four pairs of wires are arranged into two rows which are respectively located and positioned on top and bottom surfaces of the spacer.

Although four pairs of wires are located on two different rows, however, crosstalk problem may occur between two adjacent pairs of wires of the twisted-pair cable during the signal transmitting of the cable connector assembly.

Hence, an improved cable connector assembly with anti-crosstalk device is desired to overcome the above problems.

SUMMARY OF THE INVENTION

Accordingly, an object of the present invention is to provide a cable connector assembly having anti-crosstalk function.

In order to achieve the object set forth, a cable connector assembly for mating with a complementary connector comprises: an insulative housing defining a receiving space and a plurality of receiving slots communicated with the receiving space; a wire management received into the receiving space; a twisted-pair cable having a plurality of first and second conductive wires assembled to the wire management and located on different planes; a metallic piece assembled to the wire management and disposed between the plurality of first and second conductive wires; and a plurality of terminals received into the plurality of receiving slots and pierced into the plurality of first and second conductive wires.

Other objects, advantages and novel features of the invention will become more apparent from the following detailed description when taken in conjunction with the accompanying drawings.

DETAILED DESCRIPTION OF THE PREFERRED EMBODIMENT

Figure 1:
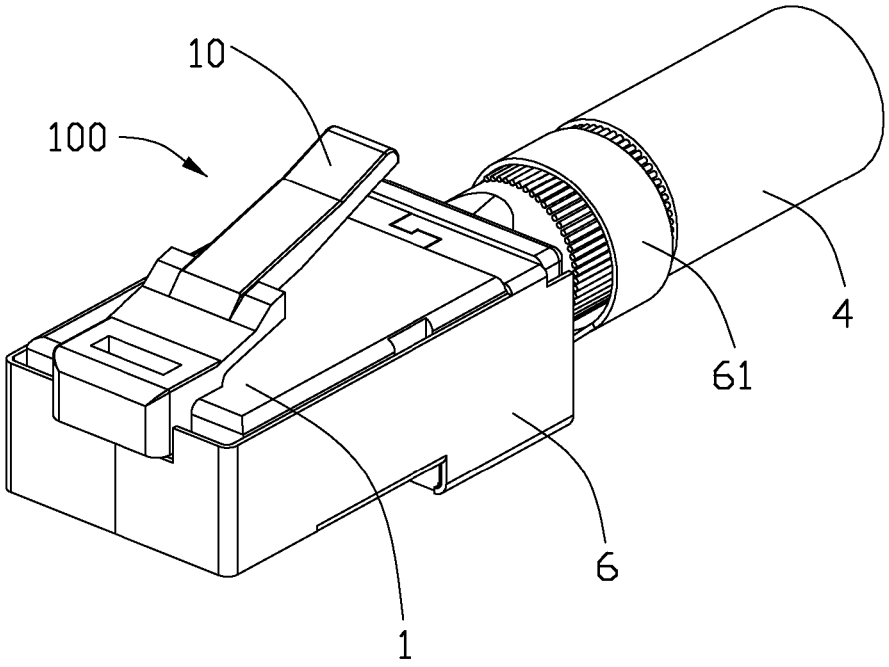
FIG. 1 is an assembled, perspective view of a cable connector assembly in accordance with the present invention.

Reference will now be made in detail to the preferred embodiment of the present invention. Referring to FIGS. 1 to 5, a cable connector assembly 100, which is essentially a modular jack having four differential pairs thereof, comprises an insulative housing 1, a plurality of conductive terminals 2 received into the insulative housing 1, a wire management 3 received into the insulative hosing 1, a twisted-pair cable 4 having a plurality of conductive wires 41, 42 connected with the terminals 2 and arranged by the wire management 3, a metallic piece 5 assembled to the wire management 3 and a metallic shell 6 assembled to the insulative housing 1 and partially shielding the insulative housing 1.

Figure 2:
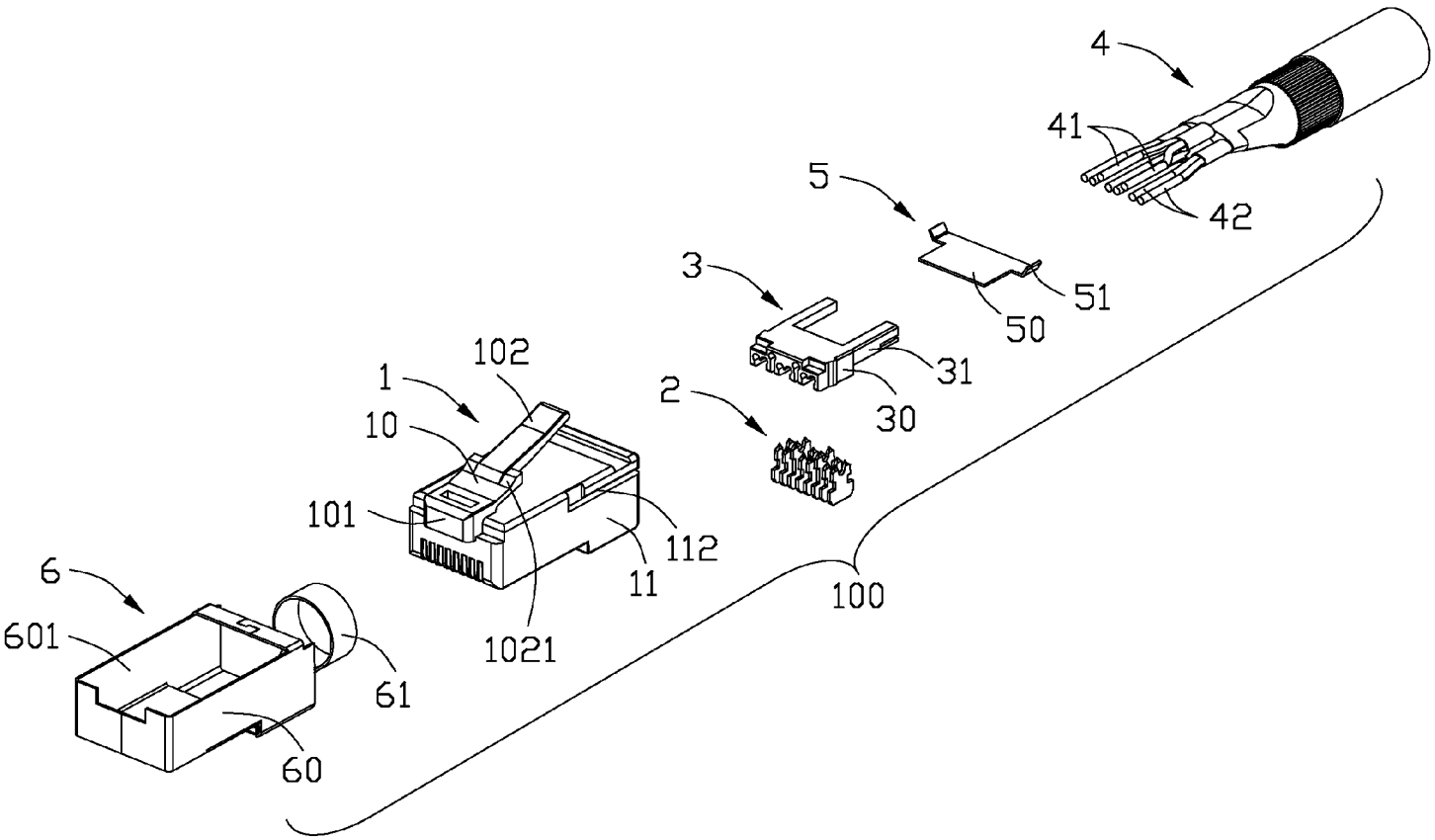
FIG. 2 is an exploded, perspective view of the cable connector assembly of FIG. 1.
Figure 3:
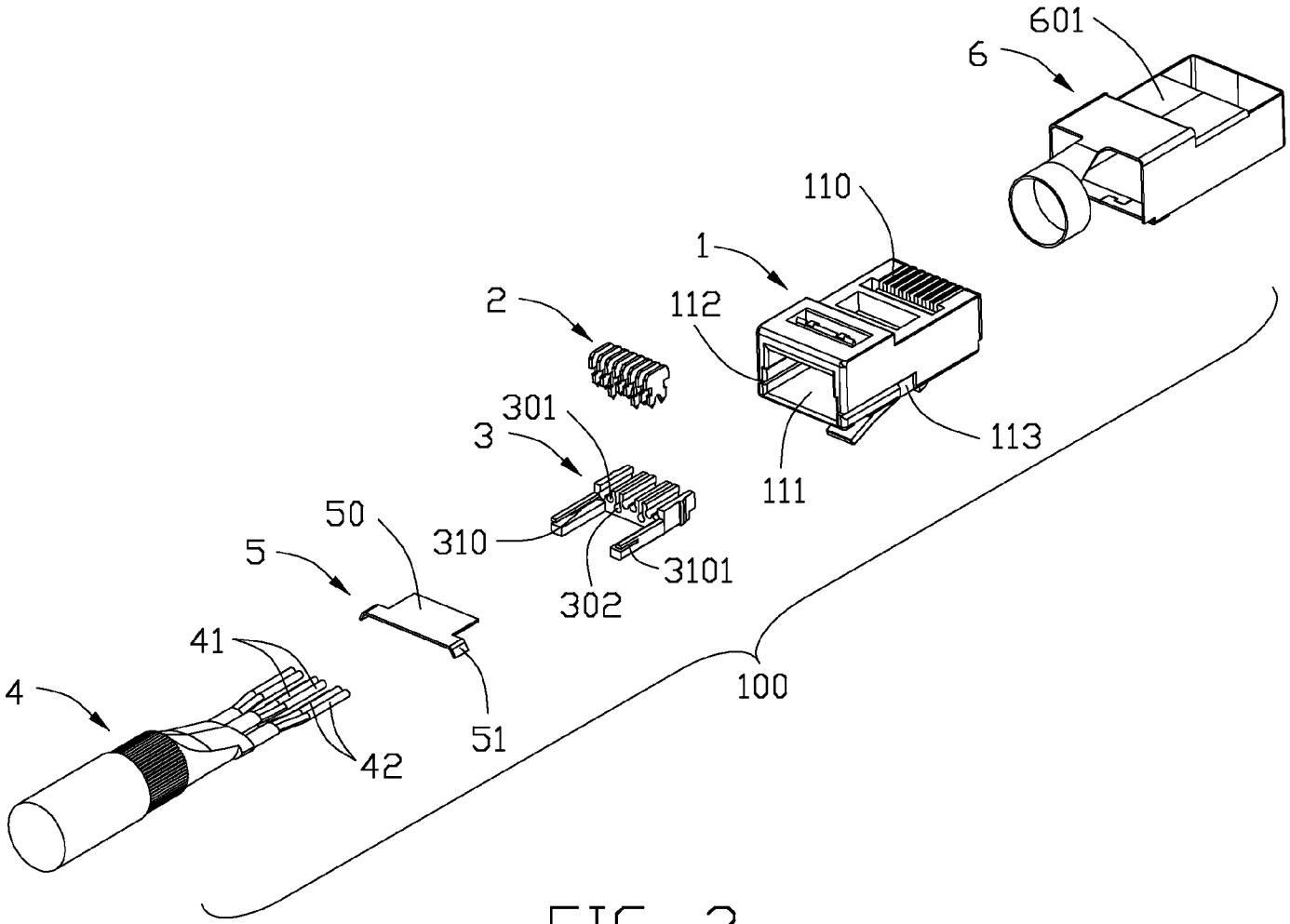
FIG. 3 is another exploded, perspective view of the cable connector assembly view similar to FIG. 2, taken from anther aspect.

Referring to FIGS. 2 to 3, the insulative housing 1 defines opposite top and bottom surfaces, opposite left and right side surfaces and opposite front and rear surfaces. The insulative housing 1 defines a resilient latch 10 formed on the top surface thereof for engaging with a complementary connector (not shown). The insulative housing 1 further defines a plurality of receiving slots 110 extending upwardly from the bottom surface thereof and extending to the front surface thereof A receiving space 111 is recessed forwardly for a distance from the rear surface of the insulative housing 1 and communicated with the plurality of receiving slots 110. The insulative housing 1 further defines two silts 112 extending inwardly from two side surfaces thereof and communicated with the receiving space 111. Two recesses 113 are formed on two opposite sides surfaces and respectively located in front of the two slits 112. The resilient latch 10 defines a projection 101 extending forwardly from the front surface of the housing 1 and a resilient pressing portion 102 extending upwardly and rearwardly from the projection 101. The resilient pressing portion 102 defines two engaging portions 1021 formed at two sides thereof for engaging and disengaging with the complementary connector.

Referring to FIGS. 2 to 3, the wire management 3 is received into the receiving space 111 along a rear-to-front direction. The wire management 3 defines a base portion 30 and a pair of arms 31 extending rearwardly from two sides of the base portion 30 and spaced apart with each other. The base portion 30 defines a plurality of first and second passages 301, 302 for receiving and positioning the conductive wires 41, 42. It should be noted that, each of the second passage 302 has a depth larger than that of the first passage 301. Each of the second passage 302 is located between two first passages 301. Each of arm 31 defines a channel 310 for receiving and supporting two sides of the metallic piece 5. Each of arm 31 further defines a slit 3101 extending from a front-to-rear direction for a lateral portion of the metallic arm 31 passing through.

Figure 4:
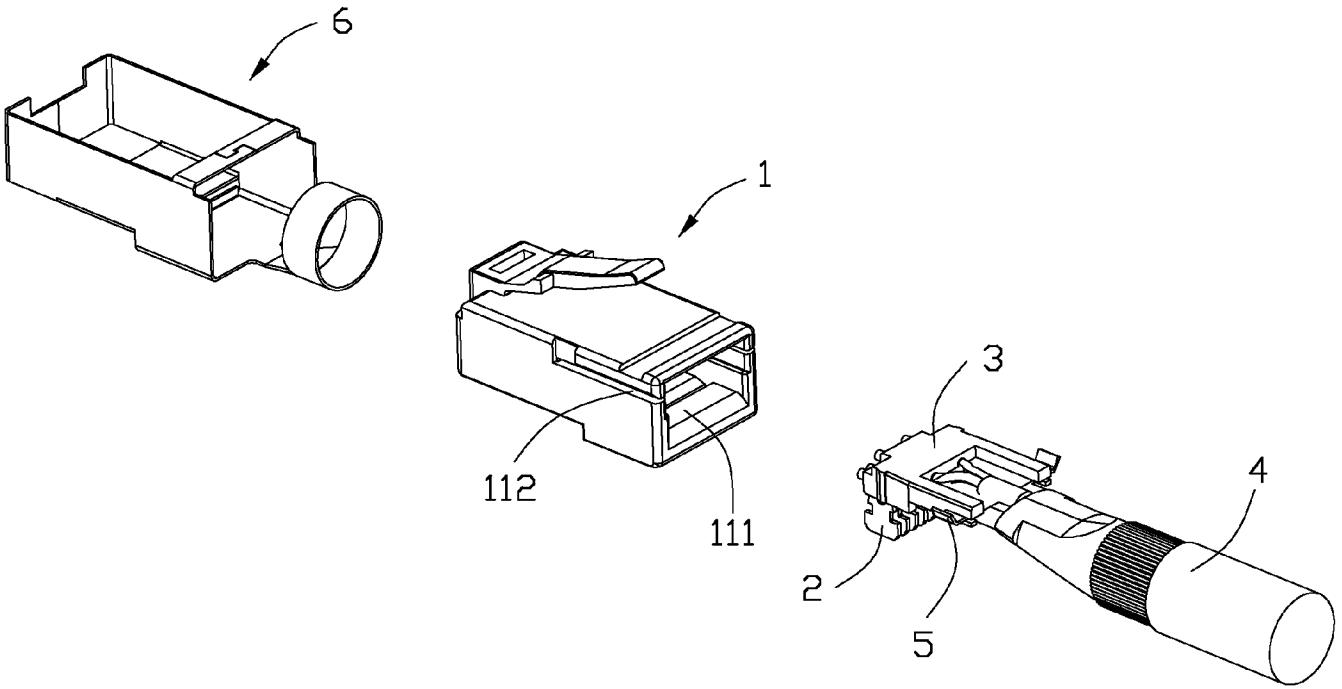
FIG. 4 is a partially, exploded view of the cable connector assembly of FIG. 1.
Figure 5:
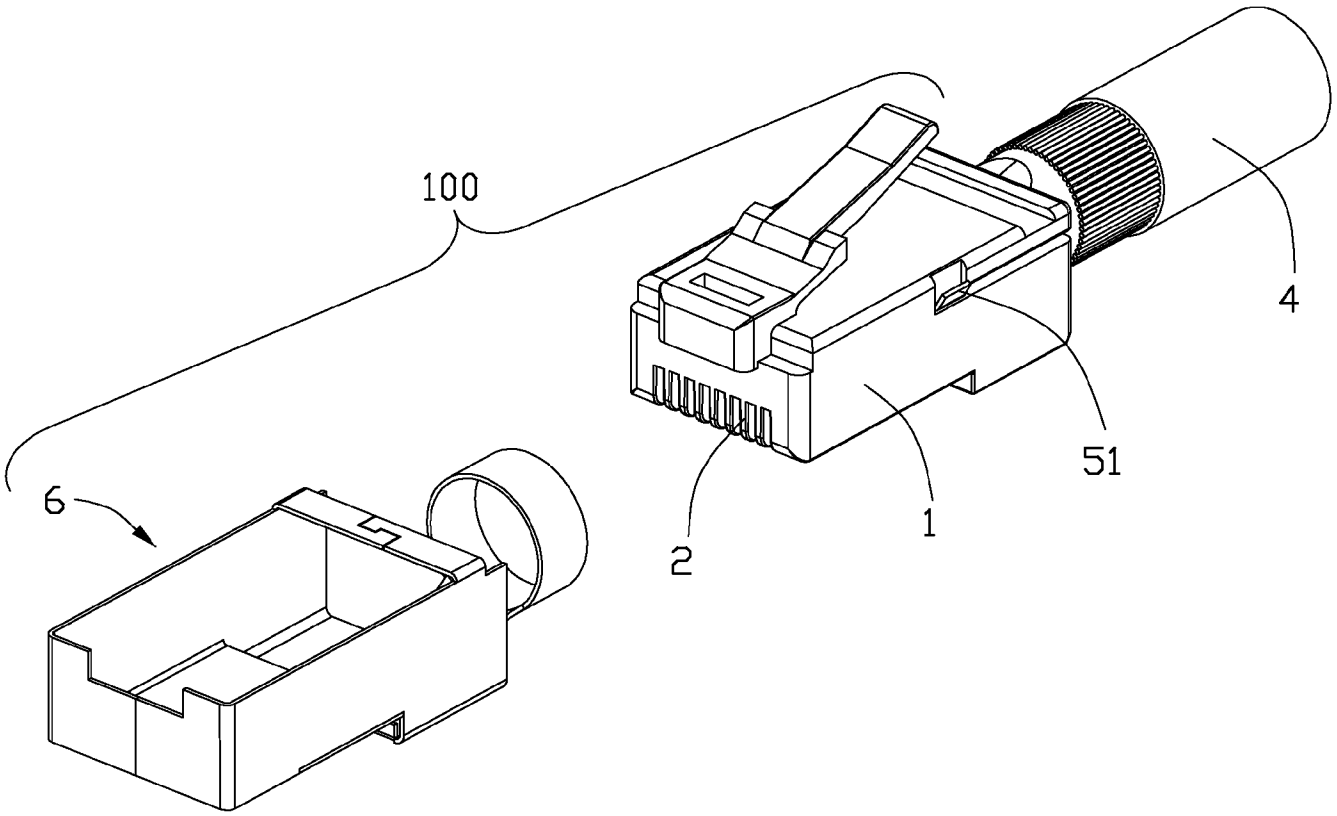
FIG. 5 is another partially, exploded view of the cable connector assembly of FIG. 1

Referring to FIGS. 4 to 5, the twisted-pair cable 4 comprises a pair of first conductive wires 41 received into the two second passages 302, three pairs of second conductive wires 42 received into six first passages 301. Thus, one pair of first conductive wires 41 and three pairs of second conductive wires 42 are located on different planes.

Referring to FIGS. 2 to 5, the metallic piece or interposer 5 is structured in a thin piece. The metallic piece 5 comprises a body portion 50 and two curved tabs 51 respectively extending outwardly from the two lateral sides of the body portion 50.

Referring to FIGS. 1 to 5, the metallic shell 6 comprise a shield portion 60 and a cable holder 61 extending rearwardly from a rear edge of the shield portion 60. The shield portion 60 has a receiving room 601 for receiving the insulative housing 1.

Referring to FIGS. 1 to 5, the assembling process of the cable connector assembly 100 made in according to present invention comprises following steps. Firstly, assembling the metallic piece 5 to the two arms 31 of the wire management 3.

And, two sides of the body portion 50 of the metallic piece 5 are received into two channels 310 of the two arms 31. The two curved tabs 51 of the metallic piece 5 are passed through two slits 3101. Secondly, assembling the two first conductive wires 41 to the two second passages 302, and assembling four second conductive wires 42 to the six first passages 301. It should be noted the metallic piece 5 is sandwiched between the first and second conductive wires 41, 42. Thirdly, assembling the wire management 3, the metallic piece 5 and the twisted-pair cable 4 to the insulative housing 1 together. The wire management 3 is received into the receiving space 111. It should be noted that two tabs 51 of the metallic piece 5 extend out of the insulative housing 1 through two slits 112 and accommodated in the two recesses 113. Fourthly, inserting the plurality terminals 2 into the receiving slots 110, the first and second conductive wires 41, 42 are pierced by the plurality of terminals 2. Finally, assembling the metallic shell 6 to the insulative housing 1. The tabs 51 of the metallic plate 5 are contacted with inner surface of the metallic shell 6. The cable holder 61 is grasped to an shielding layer (not figured) of twisted-pair cable 4.

After the above assembling steps, the entire process of assembling of the cable connector assembly 100 is finished. As the metallic piece 5 is located between two conductive wires 41 and six second wires 42. And, two tabs 51 of the metallic piece 5 are attached to the metallic shell 6. Thus, the crosstalk between the two rows of the wires 41, 42 is isolated by the metallic piece 5. As a result, the cable connector assembly 100 has good anti-crosstalk function due to the metallic piece 5 and the metallic shell 6.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly for mating with a complementary connector comprising:

an insulative housing defining a receiving space and a plurality of receiving slots arranged in one row communicated with the receiving space;

a wire management received into the receiving space;

a cable having a plurality of first and second conductive wires arranged in a differential pair manner and assembled to the wire management and located on different planes;

a metallic piece assembled to the wire management and disposed between the plurality of first and second conductive wires; and a plurality of terminals received into the plurality of receiving slots and pierced into the plurality of first and second conductive wires.

2. The cable connector assembly as claimed in claim 1, wherein the plurality of receiving slots extend upwardly from a bottom surface of the insulative housing for a distance and extend to a front surface thereof.

3. The cable connector assembly as claimed in claim 1, wherein the wire management comprises a main portion and two arms extending rearwardly from a rear end of the body portion and spaced apart with each other.

4. The cable connector assembly as claimed in claim 3, wherein each of the arm defines a slit, and the metallic defines a body portion and a pair of tabs formed at two sides of the body portion and extending out of the wire management through the two slits of the arm.

5. The cable connector assembly as claimed in claim 1, wherein the base portion defines a plurality of first and second passages for respectively receiving and positioning the second and first conductive wires, each of the second passage has a depth larger than that of the first passage.

6. The cable connector assembly as claimed in claim 4, wherein the cable connector assembly further comprises a metallic shell shielded the insulative housing and connected to the twisted-pair cable, the pair of tabs of the metallic piece are attached to the metallic shell.

7. The cable connector assembly as claimed in claim 6, wherein the insulative housing further defines two silts extending inwardly from two side surfaces thereof and communicated with the receiving space, and two recesses formed on two opposite sides surfaces thereof and respectively located in front of the two slits.

8. The cable connector assembly as claimed in claim 7, wherein the two tabs of the metallic piece are located in the two recesses through two slits of the insulative housing.

9. The cable connector assembly as claimed in claim 1, wherein the insulative housing has a resilient latch for engaging and disengaging with a complementary connector.

10. A cable connector assembly comprising:

a housing defining a receiving space and a plurality of receiving slots arranged in one row communicated with the receiving space;

a wire management received into the receiving space;

a twisted-pair cable having a pair of first conductive wires and three pairs of second conductive wires positioning on the wire management and located on different planes;

a metallic piece assembled to the wire management and located between one pair of first conductive wires and three pairs of second conductive wires;

a plurality of terminals received into the plurality of receiving slots and pierced into the corresponding first and second conductive wires; and a metallic shell partially shielding the housing and connected to the twisted-pair cable, and contacting with the metallic piece.

11. The cable connector assembly as claimed in claim 10, wherein the wire management defines a base portion and two arms extending rearwardly from the base portion, the metallic piece is supported and positioned by the two arms.

12. The cable connector assembly as claimed in claim 11, wherein the metallic piece defines a pair of tabs extending out of the housing and contacting with the metallic shell.

* * * * *